United States Patent [19]

Schroder

[11] 4,000,694

[45] Jan. 4, 1977

[54] INK FOUNTAIN IN AN INKING SYSTEM FOR PRINTING PRESSES

[75] Inventor: Peter Schroder, Offenbach, Main, Germany

[73] Assignee: Roland Offsetmaschinenfabrik Faber & Schleicher AG., Germany

[22] Filed: June 26, 1975

[21] Appl. No.: 590,846

[30] Foreign Application Priority Data

June 26, 1974 Germany ..... 2430643

[52] U.S. Cl. ..... 101/365; 101/157; 101/350

[51] Int. Cl.[2] ..... B41F 31/04

[58] Field of Search ..... 101/157, 169, 364, 365, 101/366, 350

[56] References Cited

UNITED STATES PATENTS

| | | | |
|---|---|---|---|
| 2,528,669 | 11/1950 | Schoenrock | 101/366 X |
| 2,672,812 | 3/1954 | Luehrs | 101/366 |
| 2,813,485 | 11/1957 | Harless | 101/366 |
| 2,853,005 | 9/1958 | Worthington | 101/365 |
| 2,866,411 | 12/1958 | Reed et al. | 101/366 |
| 3,186,339 | 6/1965 | Turner et al. | 101/169 X |
| 3,424,084 | 1/1969 | Chambon | 101/365 X |
| 3,730,090 | 5/1973 | Lamberg et al. | 101/365 |
| 3,779,165 | 12/1973 | Abendroth et al. | 101/365 |
| 3,820,469 | 6/1974 | Paul | 101/365 |
| 3,855,927 | 12/1974 | Simeth | 101/157 X |

FOREIGN PATENTS OR APPLICATIONS

| | | |
|---|---|---|
| 863,346 | 5/1952 | Germany |
| 432,036 | 8/1924 | Germany |

*Primary Examiner*—Edgar S. Burr
*Assistant Examiner*—Paul J. Hirsch
*Attorney, Agent, or Firm*—Leydig, Voit, Osann, Mayer & Holt, Ltd.

[57] ABSTRACT

An ink fountain for a printing press in which the fountain blade extends at an angle to the surface of the fountain roller, with adjusting pins engaging the free edge of the blade at spaced points to determine the thickness of the ink film. Each pin has a lever extending transversely of the pin at its outer end, the lever being fulcrumed with respect to the frame and having first and second relatively spaced points of engagement. The first point of engagement presses against the outer end of the pin and the second point of engagement bears against a manually rotatable key which is threaded into the frame, each pin having a return spring for urging the pin outwardly with respect to the frame so that when the key is rotated, the lever rocks about its fulcrum to advance the pin inwardly toward the blade with positive action against the restoring force of the spring. In addition, a retainer spring on each lever holds the lever in operative engagement with the key, with such spring being yieldable so that the lever may be bodily swung about the pin axis clear of the key for retraction of the lever and pin for periodic cleaning away of accumulated ink.

7 Claims, 4 Drawing Figures

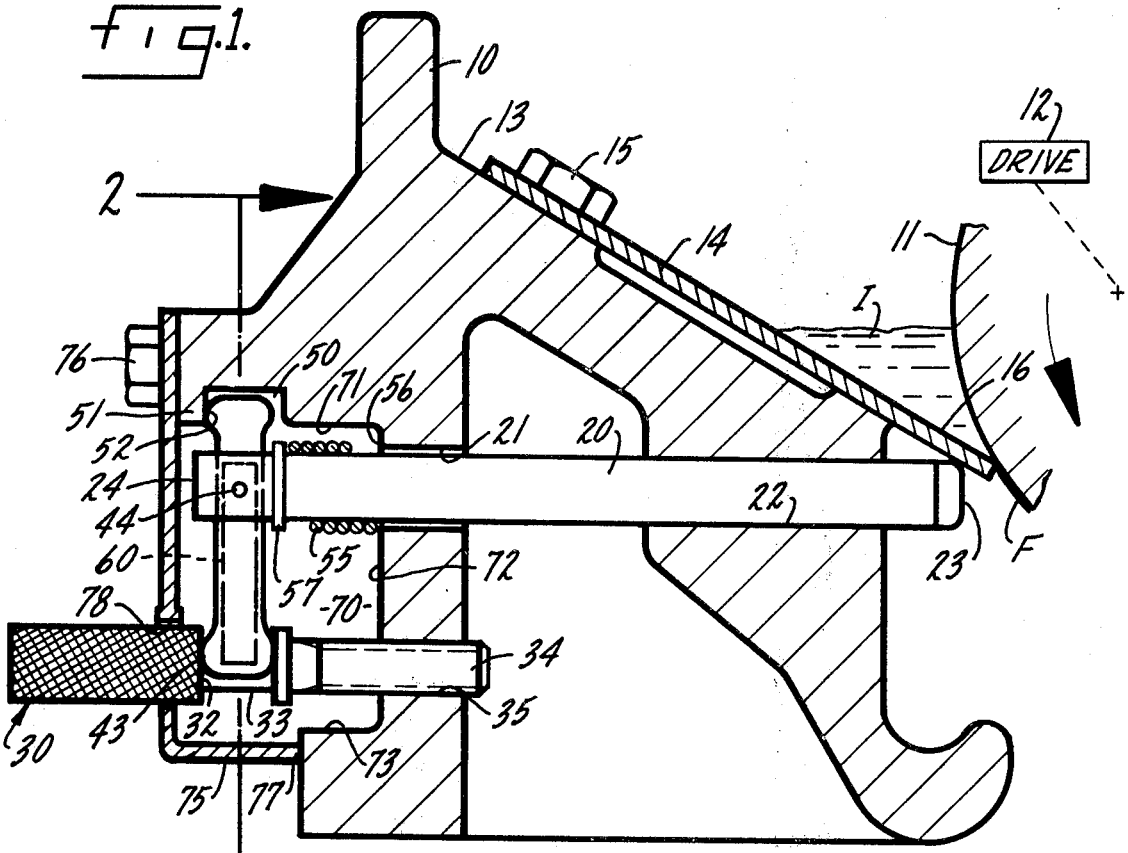
fig.1.
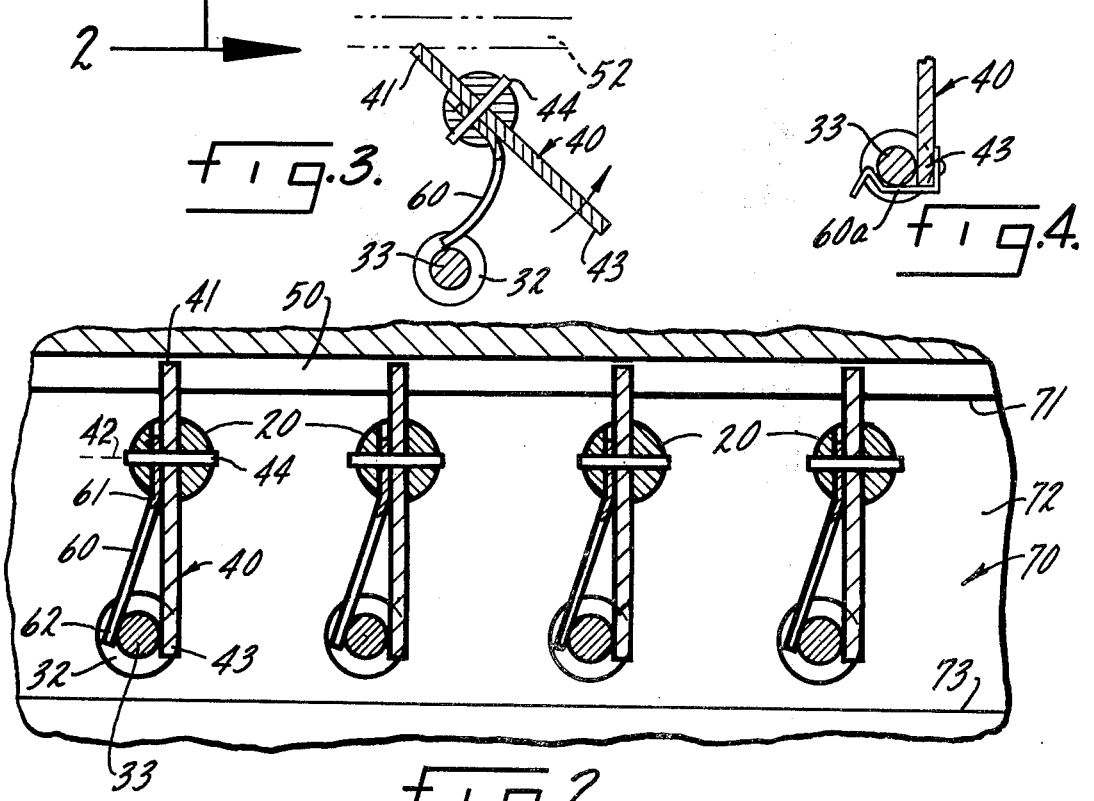
fig.3.
fig.4.
fig.2.

INK FOUNTAIN IN AN INKING SYSTEM FOR PRINTING PRESSES

Numerous patents have issued showing adjustment of a fountain blade in a printing press by means of a series of parallel adjusting pins which engage the free edge of the fountain blade at spaced points, an example being German patent No. 863,346. However such prior adjusting devices are susceptible to play or lost motion particularly after extended usage, and disassembly of the adjusting mechanism and removal of the pins for cleaning and servicing involves considerable time and effort. In another design of ink fountain shown, for example, in German disclosure specification OS No. 2,155,539 each adjusting pin and its associated adjusting nut is readily demountable as a unit from the ink fountain for cleaning and service. While the latter construction permits easier servicing, the mechanism is not free of play or lost motion, and where efforts are made to take up the lost motion by strong spring elements, sensitive and accurate adjustment becomes impossible.

It is, accordingly, an object of the present invention to provide an ink fountain having a series of pins for adjusting the fountain blade permitting adjustment in a sensitive and positive manner, with good mechanical advantage, free of any play or lost motion.

It is a related object to provide an adjusting arrangement for an ink fountain in which the parts are maintained in positive association with one another during normal adjustment and running of the press but in which the adjusting pins and their associated adjusting levers may be easily and quickly removed by a simple twist of the wrist. As a result of the fast disassembly which the construction provides, clean-up may be accomplished in a small fraction of the time required for prior devices of the same general type. Indeed, it is possible to disassemble the device for cleaning or inspection while preserving the initial adjustment.

It is a further object of the present invention to provide a mechanism for an ink fountain which permits a high degree of precision in adjustment, made up of adjusting assemblies consisting of a minimum of parts which may be economically machined within ordinary tolerances using quantity production techniques to minimize overall cost. It is a related object of the invention to provide a mechanism for a fountain blade which, although suffering a minimum of wear, insures that any wear which the parts may incur as a result of long usage does not result in play or lost motion so that the initial precision and sensitivity of adjustment is fully retained over the entire life of the device.

It is yet another object of the present invention to provide an ink fountain having a plurality of pins and associated adjusting levers and keys and in which all of the parts are accommodated within a longitudinal recess formed in the frame of the fountain, with the recess being enclosed by a cover plate for purposes of protection, cleanliness and neat appearance, the keys projecting through registered openings in the cover plate so as to be fully accessible for easy adjustment.

Other objects and advantages of the invention will become apparent upon reading the attached detailed description and upon reference to the drawings in which:

FIG. 1 is a vertical cross section taken through an ink fountain having blade adjusting means constructed in accordance with the present invention.

FIG. 2 is a diagram in the form of a vertical section taken through a plurality of pins and adjusting levers looking along the line 2—2 in FIG. 1.

FIG. 3 is a stop motion diagram showing release of a retaining spring.

FIG. 4 shows a detent spring used in lieu of a retaining spring of the leaf type.

While the invention has been described in connection with a preferred embodiment, it will be understood that I do not intend to be limited to the embodiment shown but intend, on the contrary, to cover the various alternative and equivalent constructions included in the spirit and scope of the appended claims.

Turning now to the drawing there is disclosed, in cross section, an ink fountain having a frame 10 which extends longitudinally of a fountain roller 11 having driving means 12. The frame has a downwardly angled seat 13 to which a blade 14 is secured, the blade being clamped in place, for example, by a row of machine screws 15. The free end of the blade, indicated at 16, thus extends at an angle to the surface, for the purpose of confining, above it, a body of ink I, so that when the fountain roller rotates — counterclockwise in the present instance — a film of ink F is generated on the surface of the roller.

For the purpose of adjusting the spacing between the free edge of the blade and the surface of the roller, a series of adjusting pins 20 are provided which are telescopingly received in registering openings 21, 22 which are spaced at intervals along the length of the frame 10. Each pin 20 has an inner end 23 which engages the blade and a presented outer end 24.

For adjusting each of the pins a manually rotatable key is provided which is threaded with respect to the frame along an axis parallel to the pin, and laterally spaced therefrom. Thus associated with the adjusting pin 20 shown in FIG. 1 is a rotatable key 30 having a knurled outer end, or knob, 31, an annular shoulder 32, and a shank 33 terminating in a tip 34 which is threaded into a tapped hole 35 in the frame of the fountain.

In accordance with the present invention a lever is provided which extends transversely to the pin 20 at its presented outer end, the lever having a fulcrum with first and second relatively spaced points of engagement, the fulcrum being connected to the frame, the first point of engagement engaging the pin for pressing it inwardly, and the second point of engagement being positioned by the annular shoulder on the key.

Thus, referring again to the drawing, there is shown a lever 40 having a fulcrum 41, a first point of engagement 42 with the presented end of the pin, and a second point of engagement 43 positioned adjacent the annular shoulder 32 on the key. In the preferred embodiment the levers 40 are arranged vertically, parallel to one another, as shown in FIG. 2, with the pins being connected to the central portions of their respective levers by transversely extending pivot pins 44.

For the purpose of providing a common stationary abutment for the fulcrums 41 of all of the levers, the frame is formed with a horizontally extending groove 50 defining an overhanging lip 51 presenting a lever abutting surface 52.

For the purpose of keeping the points of engagement of the lever 40 solidly bottomed and for taking up any play at the pivot pin 44 or in the thread, as well as for retracting the pin from the blade, a return spring is provided in the form of a coil spring 55 of the compression type surrounding the pin 20. At its inner end the spring seats against a land surface 56 on the frame and at its outer end the spring presses against an annular shoulder 57 mounted near the end of the pin. The return spring is preferably quite stiff so as to be able to positively retract the pin against any stickiness which might develop. For example, the spring preferably exerts a force but such force is readily overcome by the mechanical advantage of the lever (on the order of 3:1) and use of a low pitch thread at the key.

In accordance with one of the aspects of the present invention, a retaining spring is provided on each of the levers for retaining the lever in the path of axial movement of the shoulder on the key to hold the adjusting arrangement tightly and reliably together during normal adjustment and use, but with the spring arranged to yield when the lever and pin are twisted about the pin axis for the purpose of disengaging the lever from the key so that the pin and lever, together, may be withdrawn from the registering openings in the frame for periodic cleaning. In the present instance a retaining spring 60 associated with each of the pins has a first end 61 which is held in place against the lever by the pivot pin 44 which engages a registering opening in the end of the spring. The retainer spring 60 has a free, downwardly extended, end 62 which is stressed in the direction of the lever so as to hold the shank 33 of the key snugly between the retainer spring and the lever, the effect being to insure that the lower end 43 of the lever 40 is reliably positioned in the path of axial movement of the shoulder surface 32 on the key. The retainer spring 60 and the lower end of the lever thus, together, form a fork or yoke which straddles the shank 33 of the key, but which permits prompt and easy disengagement of the lever from the key for purposes of disassembly. Thus as shown in FIG. 3, all that need be done to disassemble a lever from its associated key is to twist the lever slightly about the pin axis in a counterclockwise direction, whereupon the retainer spring 60 flexes and wipes clear of the shank 33. At the same time the upper point of engagement 41, which forms the fulcrum of the lever, rotates clear of the abutting surface 52 of the frame so that the pin and lever, together with return spring 55, may be axially withdrawn from the registering openings 21, 22. Any accumulated ink residue, more particularly, the gummy mixture of accumulated ink and paper dust, may be removed from the pin, and the registering openings, to insure that the pin and lever may operate freely.

Reinstallation is equally simple: The pin 20, after cleaning, is telescoped back into position, with the lever held at an angle, and then rotated clockwise into the vertical position shown in FIG. 2, lifting the spring 60 as necessary to "clear" the shank of the key. If desired the spring may be formed to "detent" out of position, and back into position, with simple twisting of the lever, by forming the spring as shown at 60*a* in FIG. 4.

It is one of the features of the present invention that the presented ends of all of the pins 20 and their associated levers 40 occupy a common, longitudinally extending recess formed, with the recess being enclosed by a longitudinally extending cover plate. Thus as shown in FIG. 1 a recess 70, in the form of a longitudinally extending groove machined in the frame, is defined by surfaces 71, 72, 73, the recess being enclosed by a longitudinally extending closure plate 75 of L cross section which is held in place, along its upper edge, by a row of machine screws 76, with the lower edge 77 being pressed into resilient engagement with the lower edge of the frame 10. The outer, knurled ends 31 of the keys 30 are extended outwardly through clearance apertures 78 in the closure plate. If desired, the lands surrounding the apertures may be marked with radially extending graduations cooperating with an index on the key as a guide to relative adjustment.

In a typical adjusting cycle a key 30 is screwed inwardly, advancing the annular shoulder 32 against the lower end 43 of the lever 40. This causes the lever 40 to rock about its upper fulcrum 41 in a counterclockwise direction, thereby swinging the pivot pin 44 to the right as illustrated in the drawing against the restoring force of the return spring 55 to advance the inner end of the pin 20 against the blade, thereby to cut down the thickness of ink film F, in the region of the pin, to a desired running level. Such adjustment is repeated for each of the pins.

When it is desired to increase the thickness of the film, the key 30 is slightly unscrewed with respect to the frame, causing the shoulder 32 to retreat, and with such retreating movement being followed up by expansion of the return spring 55 and rotation of the lever 40 clockwise, through a small angle, about its upper fulcrum 41, accompanied by proportional and precise backing off of the pin. The return spring 55 may be made rather stiff to keep all of the engaged surfaces constantly bottomed, as stated, to overcome any tendency toward sticking. Nevertheless, because of the mechanical advantage of the key as a result of the length ratio of the lever arms and pitch of the thread 35, it is possible to overcome the restoring force of even a stiff spring by relatively light manual adjusting forces, thereby providing a high degree of sensitivity and response completely free of any play or lost motion in the system. Any wear which may occur after the mechanism has been employed for a long period of time does not result in lost motion since it is constantly taken up by the return spring.

It will be apparent that despite the operating advantages, including ease of adjustment, lack of play and ease of disassembly, the present fountain is, overall, highly economical to manufacture since the pin-lever assemblies, of which as many as 50 or more may be required in a single fountain, may be cheaply manufactured on a quantity production basis. Machining of the frame is also economical since the bores 21, 22, 35 need not be spaced or oriented with respect to one another with a high degree of precision. Even the thread 35 need not be of high precision since any endwise play which may exist or develop is constantly taken up by the return spring 55.

While it is preferred to employ a key 30 which is threaded into the frame of the fountain, it will be apparent that the invention is not limited to this, and if desired, the shank portion 33, 34 of the key may be fixed in the frame and a thread may, instead, be interposed between the knob 31 and the shank, with the latter extending axially into the knob.

If it is desired to remove and replace each pin and lever assembly without disturbing the key adjustment, a simple gripping tool may be provided for engaging the central portion of the lever to compress the return spring to release the pressure at the key at the same time that the lever is swung laterally away from the key, the procedure being reversed when the pins are reinstalled.

What is claimed is:

1. In an ink fountain for a printing press, the combination comprising a fountain roller having means for rotating the same, a frame extending parallel to the fountain roller and mounting a fountain blade confining a body of ink, the blade extending at an angle to the surface of the roller and (with the) having a free edge thereof in proximity to the surface to define a film of ink thereon as the roller rotates, a series of adjusting pins extending slidably through registering parallel openings in the frame and engaging the free edge of the blade at spaced points thereby to position the blade with respect to the surface, each pin having its inner end in engagement with the blade and having a presented outer end, a vertically extending lever arranged transversely with respect to each pin, with the central portion of the lever being connected to the presented outer end of the pin, a manually rotatable key for each pin threaded with respect to the frame along an axis parallel to the pin and laterally spaced from the pin, an abutting surface on the frame adjacent one end of the lever to provide a fulcrum, the other end of the lever being engaged by the key, and a return spring for urging the pin outwardly with respect to the frame so that when the key is rotated the lever rocks about its fulcrum to move the pin inwardly against the blade with positive action against the restoring force of the return spring, each lever and associated pin being manually rotatable as a unit about the pin axis for simultaneous disengagement of the one end of the lever from the abutting surface on the frame and disengagement of the other end from the associated key thereby to permit withdrawal of the lever and pin for purposes of cleaning and maintenance while leaving the key in adjusted condition.

2. In an ink fountain the combination comprising a fountain roller having means for rotating the same, a frame extending parallel to the fountain roller and mounting a fountain blade confining a body of ink, the blade extending at an angle to the surface of the roller and (with the) having a free edge thereof in proximity to the surface to define a film of ink thereon as the roller rotates, a series of adjusting pins extending slidably through registering parallel openings in the frame and engaging the free edge of the blade at spaced points thereby positioning the blade with respect to the surface, each pin having its inner end in engagement with the blade and having a presented outer end, a longitudinal recess formed in the frame for enclosing the outer ends of all of the pins, vertically extending levers in the recess arranged transversely on the respective pins, with the central portion of each lever being (pivoted) pivotally connected to the outer end of the associated pin to form a pin and lever assembly, all of the pin and lever assemblies being identical, a lip on the frame overhanging the recess and extending longitudinally therealong for abutting the first end of each of the levers and serving as a common fulcrum (therefor) for all of the levers, manually rotatable keys threaded with respect to the frame along axes parallel to the pins, the keys having annular shoulders adjacent the second ends of the respective levers, return springs for urging the pins outwardly with respect to the frame so that when the keys are rotated the shoulders thereon rock the levers (rock) about their (fulcrum) fulcrums to move the respective pins inwardly against the blade with positive action against the restoring force of the return springs, (and) a longitudinally extending cover plate secured to the frame for totally enclosing the recess, the keys extending through the cover plate for purposes of access, each pin and lever assembly being manually rotatable as a unit about the pin axis for simultaneous disengagement of the first end of the lever from the lip on the frame and disengagement of the second end of the lever from the annular shoulder on the associated key so that each pin and lever assembly may be manually withdrawn from the frame for purposes of cleaning and maintenance while leaving the key in adjusted condition.

3. In an ink fountain for a printing press, the combination comprising a fountain roller having means for rotating the same, a frame extending parallel to the fountain roller and mounting a fountain blade confining a body of ink, the blade extending at an angle to the surface of the roller and (with the) having a free edge thereof in proximity to the surface to define a film of ink thereon as the roller rotates, a series of adjusting pins extending slidably through spaced parallel openings in the frame for engaging the free edge of the blade at spaced points and thereby positioning the blade with respect to the surface, each pin having its inner end in engagement with the blade and having a presented outer end, a manually rotatable key for each pin threaded with respect to the frame along an axis parallel to the pin and laterally spaced therefrom, the key having an annular axially facing shoulder thereon, a lever extending transversely to the pin at its presented outer end and having a fulcrum with first and second points of engagement spaced from the fulcrum, an (abutment) abutting surface on the frame supporting the fulcrums of all of the levers, the first point of engagement engaging the outer end of the pin and the second point of engagement engaging the shoulder on the key, and a return spring for urging the pin outwardly with respect to the frame so that when the key is rotated to advance the shoulder against the lever the lever rocks about its fulcrum to move the pin inwardly with positive action against the restoring force of the return spring, each lever and its associated pin being manually rotatable as a unit about the pin axis for simultaneously disengaging the lever from the abutting surface and from the associated key thereby to permit withdrawal of the lever and pin for purposes of cleaning and maintenance.

4. In an ink fountain for a printing press, the combination comprising a fountain roller having means for rotating the same, a frame extending parallel to the fountain roller and mounting a fountain blade confining a body of ink, the blade extending at an angle to the surface of the roller and (with the) having a free edge thereof in proximity to the surface to define a film of ink thereon as the roller rotates, a series of adjusting pins extending slidably through spaced parallel openings in the frame for engaging the free edge of the blade at spaced points and thereby positioning the blade with respect to the surface, each pin having its inner end in engagement with the blade and having a presented outer end, a manually rotatable key for each pin threaded with respect to the frame along an axis parallel to the pin and laterally spaced therefrom, the key having a shank with an annular axially facing shoulder formed thereon, a lever extending transversely to (the) each pin at its presented outer end and having a fulcrum with first and second points of engagement spaced from the fulcrum, an abutment on the frame for each lever serving as a fulcrum, the first point of engagement engaging the outer end of the pin and the second point of engagement engaging the shoulder on the key with the lever positioned flatly adjacent the shank, a return spring for urging (the) each pin outwardly with respect to the frame so that when the key is rotated to advance the shoulder against the lever the lever rocks about its fulcrum to move the pin inwardly with positive action against the restoring force of the return spring, (and) a (retaining) retainer detent spring mounted on (the) each lever to hold it resiliently in position adjacent the shank of the associated key, each lever and its associated pin being manually rotatable as a unit about the pin axis for overcoming the force of the detent spring and for simultaneous disengagement of the lever from the abutment on the frame and from the shoulder on the associated key, thereby to permit withdrawal of the lever and pin as a unit for purposes of cleaning and maintenance while leaving the associated key threaded into the frame.

5. In an ink fountain for a printing press, the combination comprising a fountain roller having means for rotating the same, a frame extending parallel to the fountain roller and mounting a fountain blade confining a body of ink, the blade extending at an angle to the surface of the roller and (with the) having a free edge thereof in proximity to the surface to define a film of ink thereon as the roller rotates, a series of adjusting pins extending slidably through registering parallel openings in the frame and engaging the free edge of the blade at spaced points thereby to position the blade with respect to the surface, each pin having its inner end in engagement with the blade and having a presented outer end, the frame having a longitudinally extending recess surrounding the presented ends of all of the pins, vertically extending levers in the recess arranged transversely on the respective pins, the central portion of each lever being pivoted to the outer end of the associated pin to form removable assemblies, an abutting surface on the frame (adjacent) extending along one side of the recess and in engagement with one end of each of the (lever) levers and in engagement therewith to act as a fulcrum, each pin and lever having a manually rotatable key threaded with respect to the frame along an axis parallel to the pin and lying adjacent the other end of (the) each lever, each key having a shank and an adjacent annular shoulder, means including a retainer detent spring on the lever tending to hold the lever against the shank for positioning of the lever and pin by the annular shoulder on the key as the key is turned, a stiff return spring for urging each pin outwardly with respect to the frame so that when the associated key is rotated the associated lever rocks about its fulcrum to move the pin inwardly against the blade with positive action against the restoring force of the return spring, each lever and associated pin being manually rotatable as a unit about the pin axis for simultaneous disengagement of the one end of the lever from the abutting surface on the frame and disengagement of the other end from the shoulder on the associated key thereby to permit withdrawal of the lever and pin for purposes of cleaning and maintenance while leaving the key in adjusted condition, and a longitudinal cover plate for enclosing the recess with the keys extending through the cover plate for ready access.

6. The combination as claimed in claim 5 in which the retainer detent spring is in the form of a leaf spring on the lever to hold the lever resiliently and temporarily captive against the shank of the key.

7. In an ink fountain for a printing press, the combination comprising a fountain roller having means for rotating the same, a frame extending parallel to the fountain roller and mounting a fountain blade confining a body of ink, the blade extending at an angle to the surface of the roller and (with the) having a free edge thereof in proximity to the surface to define a film of ink thereon as the roller rotates, a series of adjusting pins extending slidably through registering parallel openings in the frame for engaging the free edges of the blade at spaced points and thereby positioning the blade with respect to the surface, each pin having its inner end in engagement with the blade and having a presented outer end, a manually rotatable key for each pin threaded with respect to the frame along an axis parallel to the pin and laterally spaced therefrom and facing an annular shoulder, a lever extending transversely with respect to the each pin at its outer end and having a fulcrum with first and second relatively spaced points of engagement, the frame providing an abutting surface for the fulcrum, the first point of engagement being pivoted to the pin so that the pin and lever are attached to one another to form an assembly, and the second point of engagement lying adjacent the key in the path of the annular shoulder, a return spring urging the pin outwardly with respect to the frame so that when the key is rotated the shoulder thereon is advanced against the lever which rocks about its fulcrum to advance the pin inwardly against the blade with positive action against the restoring force of the return spring, the lever having a (retaining) detent retainer spring thereon engaging the key for holding the lever in the path of movement of the shoulder on the key but with the spring being capable of flexing and release from the key as the pin and lever are bodily rotated through an angle about the pin axis thereby to permit simultaneous disengagement of the lever from the key and disengagement of the fulcrum from the abutment on the frame so that each pin and its attached lever are free to be retracted endwise from the registering opening for purposes of cleaning and maintenance.

* * * * *